US005173071A

United States Patent [19]

Hoeting

[11] Patent Number: 5,173,071

[45] Date of Patent: Dec. 22, 1992

[54] HIGH SPEED TOY VEHICLE AND LAUNCHER THEREFOR

[75] Inventor: Michael G. Hoeting, Chicago, Ill.

[73] Assignee: Toymax Inc., Cedarhurst, N.Y.

[21] Appl. No.: 764,521

[22] Filed: Sep. 24, 1991

[51] Int. Cl.[5] ..... A63H 29/00; A63H 17/34

[52] U.S. Cl. ..... 446/429; 446/414; 446/465

[58] Field of Search ..... 446/429, 430, 409, 470, 446/471, 465, 462, 459, 284, 290, 414; 273/86 R, 129 P, 86 D; 124/10

[56] References Cited

U.S. PATENT DOCUMENTS

| | | | |
|---|---|---|---|
| 1,256,575 | 2/1918 | Koprinski | 124/10 |
| 1,502,634 | 7/1924 | Ingebritson | 124/10 X |
| 2,816,536 | 12/1957 | Profitt | 124/10 |
| 3,075,769 | 1/1963 | Cunningham . | |
| 3,411,236 | 11/1968 | Fileger et al. | 446/420 |
| 3,816,958 | 6/1974 | Winston | 446/462 |
| 3,952,442 | 4/1976 | Livesey et al. | 446/429 |
| 4,423,871 | 1/1984 | Muscaro | 273/86 R |
| 5,022,884 | 6/1991 | Hippely et al. | 446/470 X |

FOREIGN PATENT DOCUMENTS

| | | | |
|---|---|---|---|
| 51916 | 7/1936 | Denmark | 273/318 |
| 3528 | 6/1905 | United Kingdom | 124/10 |

*Primary Examiner*—Mickey Yu
*Attorney, Agent, or Firm*—Rosen, Dainow & Jacobs

[57] ABSTRACT

A toy vehicle and launcher therefor are disclosed. The toy vehicle includes a freely rotatable roller positioned over a rear portion of the vehicle extending substantially outwardly from an opening accessible generally from above the vehicle, whereby when a generally downward and rearward force is applied to the roller, a forward thrust is imparted to the vehicle propelling the vehicle and driving it in a forward direction. The toy vehicle comprises a chassis, two wheels, snap-fit structure for mounting the wheels to the chassis to rotate about a first axis, the roller, snap-fit structure for mounting the roller to the chassis to rotate about an axis generally above the first axis, and the body which has an opening through which the roller projects. The toy vehicle is also provided with a noise maker. The launcher includes two relatively stiff elongated members of approximately the same size hingedly connected together at respective first ends thereof. The members are configured to receive the vehicle therebetween with one of the members in contact with the roller, and to launch the vehicle from therebetween upon the application of a force moving one or the other of the members towards the other, or both of the members together. The vehicle may also be launched without a launcher by one's finger(s), fist, foot, etc., to apply the force described above. If desired, the vehicle may be launched onto a track, which may be connected to the launcher if one is used.

18 Claims, 3 Drawing Sheets

110
111
112
12
14
16
19
20
22
24
24a
10
15
32
36
116
120
121
122
129
130
131

12
20
114
16
10
111
112
110
22
19
121
120
122
120
24a
24
121

20
114
12
16
101
103
64
72
50
82
89
86
87
15
58
85
10
93
91
60
32
66
62
47
14
38
34
40
42
36
30
19

16
10
22

HIGH SPEED TOY VEHICLE AND LAUNCHER THEREFOR

BACKGROUND OF THE INVENTION

The present invention relates to a toy vehicle which may be propelled by a launcher or by manual launching. The launcher may be connected to a track so that the toy vehicle when launched by the launcher is propelled onto the track.

A toy vehicle and launcher therefor are disclosed in U.S. Pat. No. 3,952,442 (Livesey et al.). The launcher comprises an elongated member which when pressed against a sloping body portion of the vehicle resting on a surface launches the vehicle along the surface. The launcher may also include a base member swingably connected to the elongated member. The vehicle is positioned for launching between the two members with the elongated member positioned above the sloping body portion of the vehicle and the base portion positioned therebelow. A child may step on the elongated member with a downward force to launch the vehicle from between the two members.

While there may be entertainment value to the above-described toy, such entertainment value may be greatly enhanced by propelling the vehicle at higher speeds, and/or for longer distances, and/or by making the speed or distance achieved by a particular user to be dependent to a certain extent on skill and technique.

SUMMARY OF THE INVENTION

It is an object of the present invention to provide an improved toy vehicle which may be launched generally as described above.

It is another object of the present invention to provide a toy vehicle which may be launched generally as described above but one which has enhanced entertainment value.

It is another object of the present invention to provide a toy vehicle which is simple in construction, manufacture and operation.

It is another object of the invention to provide a toy vehicle and launcher combination in which the vehicle is launched by the launcher at high speeds.

It is another object of the invention to provide a toy vehicle which may be launched independently of a launcher and which yet may be launched at high speed.

It is another object of the invention to provide a toy vehicle and launcher combination in which the vehicle may be launched onto a track.

It is an object of the present invention to provide a toy vehicle having snap on accessories such as motors.

The invention achieves various of these and other objects by providing a toy vehicle which includes a movable means which cooperates with a launcher, or a with person's body part (such as a finger or fingers, hand or foot, etc.) functioning as a launcher, to launch the vehicle. The vehicle is positioned with one part thereof adjacent a launching surface, and the launcher or person's body part is positioned adjacent the movable means of the vehicle so as to be capable of making a closing movement relative to the surface (or vice versa, or by movement of both the surface and the launcher or body part) and thereby apply a squeezing or wedging force to the vehicle while leaving an opening from which the vehicle may exit as the space within which the vehicle was positioned for launching is closed. The launching surface may be part of the launcher and/or another surface such as a floor or track along which the vehicle is to be propelled.

In the preferred embodiment, the movable means functions as a roller relative to the launcher or body part to permit rapid movement of the launcher or body part relative to the launching surface, to thereby permit the launcher or body part to propel the vehicle from between the launching surface and the launcher or body part at high speed. In the preferred embodiment, the movable means is a roller rotatably supported by the vehicle adjacent an upper, rear portion thereof. However, the movable means may comprise a surface supported by the vehicle for motion other than rotary. For example, the vehicle may support a surface which is reciprocated along a linear or curved path by the launcher.

A toy vehicle in accordance with the invention comprises means for supporting the vehicle on a support surface so that the vehicle may be moved along the support surface with relatively low friction resisting movement of the vehicle along the surface, and movable means positioned to be acted upon by a generally downwardly and rearwardly force applied by a launcher or body part and to move in response to the force to cause the force to propel the vehicle forwardly.

In the preferred embodiment the supporting means comprises wheels or other movable structure for facilitating motion of the vehicle along the launching surface or track or other surface. Preferably, the vehicle has spaced wheels on an axle or for rotation about an axis, and the movable means is positioned generally above the axle or axis. In the preferred embodiment the vehicle does not include means for driving it and is propelled solely as a result of launching. However, the vehicle may also be provided with driving means.

The movable means in the preferred embodiments comprises the roller referred to above positioned over a rear portion of the vehicle and extending substantially outwardly from an opening accessible generally from above the vehicle, whereby when a generally downward and rearward force is applied to the roller, a forward thrust is imparted to the vehicle propelling the vehicle and driving it in a forward direction.

In a specfic preferred embodiment, the toy vehicle may comprise a chassis, two wheels, means mounting the wheels to the chassis to rotate about a first axis, the roller, means for mounting the roller to the chassis to rotate about an axis generally above the first axis, a body having an opening through which the roller projects, and means for attaching the body to the chassis. The mounting means permits the wheels and the roller to be mounted to and held by the chassis before the body is mounted thereto. This permits the chassis to be mounted with all parts except the body as a chassis sub-assembly. The body may include means for holding parts mounted in the chassis in place during operation of the vehicle.

The toy vehicle preferably includes a weight which both stabilizes the vehicle and gives it mass to increase its inertia so that after launch such inertia continues to propel the vehicle. The toy vehicle may also include a noise maker which makes a high speed sound during launching of the vehicle. Preferably, the noise maker and the weight are also mounted to the chassis and held therein prior to assembly of the body to the chassis; however, as mentioned above, means may be provided in the body to cooperate with the chassis mounting.

A launcher in accordance with the invention for launching and propelling a toy vehicle comprises a relatively flat, relatively stiff elongated member configured to contact the movable means and apply the force thereto. The relatively stiff member may have some flex to it and which when placed adjacent the movable means and forcefully moved towards the launching surface moves the movable means in a direction generally opposite to that along which the vehicle is to be propelled. Such movement of the movable means allows the stiff launching member to be moved at high speed relative to the vehicle and thereby launch the vehicle at high speed as a result of the forces generated by the wedging or squeeze action of the member and the launching surface. One may use his finger, fingers, hand, fist or foot to move the launcher depending on vehicle and/or launcher size, construction, etc. Substantially the same effect may be obtained using one's finger, fingers, hand, fist or foot as a launcher, as indicated above.

In a preferred embodiment, the launcher comprises two relatively stiff members of generally the same size and shape hingedly or pivotally connected together at respective first ends thereof so that the members may be moved towards and away from each other in the squeeze or wedge fashion described above. One member is positioned on a launching surface such as a floor or pavement, or on a table, etc., and the vehicle is placed over that member in contact therewith and/or with the launching surface. The other member is then moved forcefully towards the one surface, for example with a fist or foot stomping action. The launcher may include structure for suitably positioning the vehicle in the launcher, and structure for assisting engagement by the launcher of the vehicle movable means.

The invention also provides a game which includes the toy vehicle and the launcher, and may also include the track.

BRIEF DESCRIPTION OF THE DRAWINGS

The invention is illustrated by way of example and not limitation in the figures of the accompanying drawings in which like references refer to like or corresponding parts, and in which.

DESCRIPTION OF THE PREFERRED EMBODIMENTS

It will be understood that the invention is not limited to the embodiments described and that the drawings are for purposes of illustration only and are not intended as a definition of the limits of the invention.

Figures 1, 6, 7, 8:
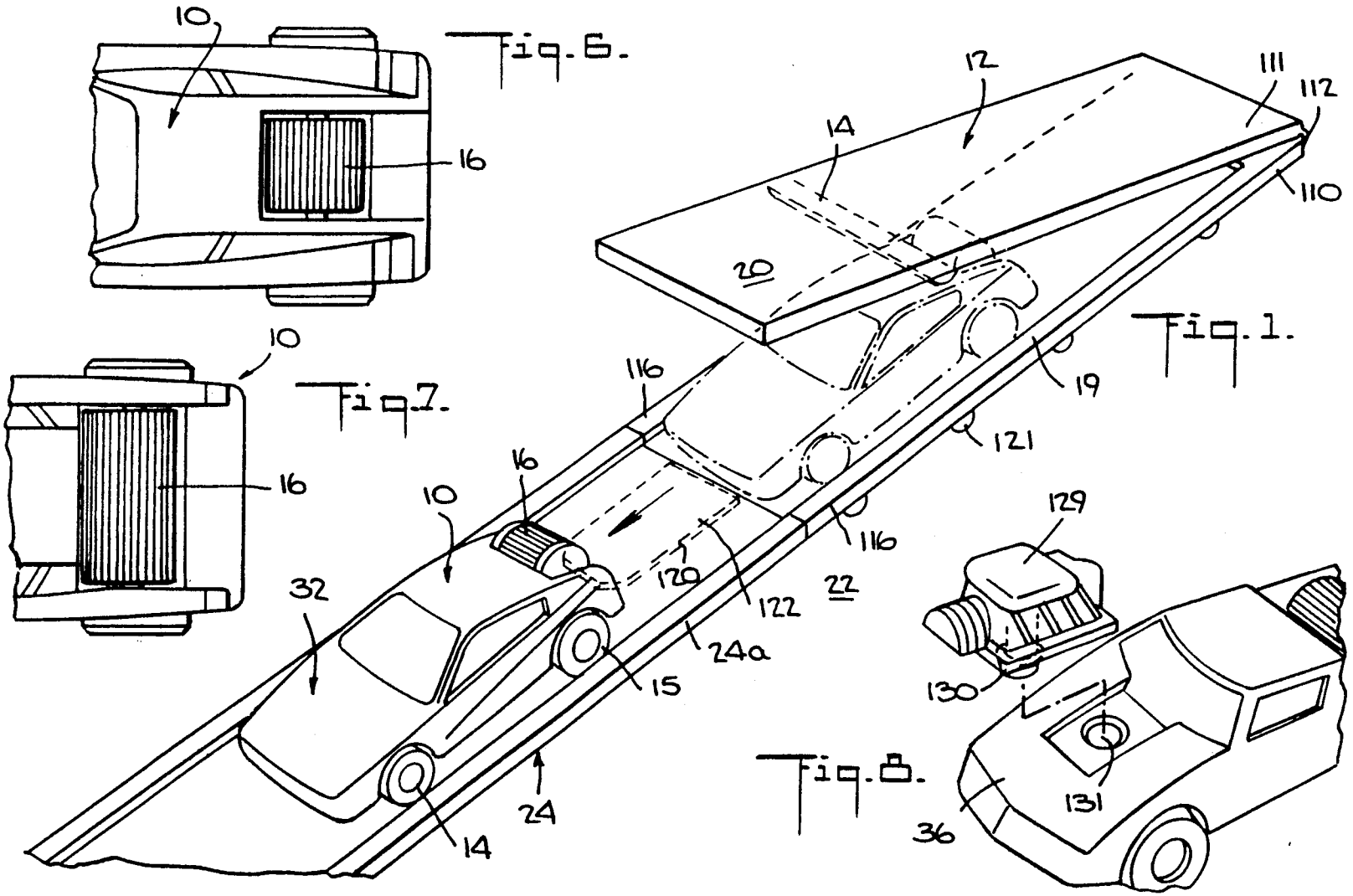
FIG. 1 is a perspective view of a toy vehicle and launcher according to the invention showing the vehicle in broken lines prior to launching and in solid lines after launching, with the lower portion of the launcher being connected to a track.
FIGS. 6 and 7 are plan views of the rear portion of toy vehicles according to embodiments of the invention with different length rollers at the rear of the respective vehicle.
FIG. 8 is an exploded perspective view of a portion of a toy vehicle of the invention according to an embodiment of the invention having a removable accessory in the form of an engine.
Figure 5:
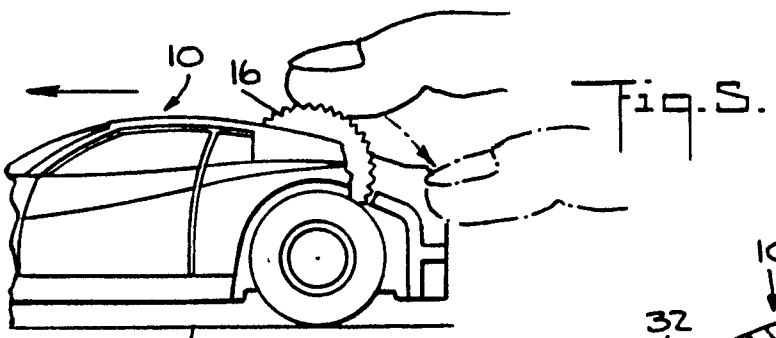
FIG. 5 is a side view of the rear portion of the toy vehicle according to the invention showing manual launching of the vehicle.

Referring to FIGS. 1 and 5, toy vehicle 10 according to the invention may be launched by a launcher 12 (FIG. 1) or by one's finger (FIG. 5) (or by one's hand, etc.). Vehicle 10 includes free-rolling front wheels 14 and free wheeling rear wheels 15 on which the vehicle rolls and a roller 16 (an embodiment of the movable means) positioned in the rear portion of the vehicle. As shown in FIG. 1, launcher 12 includes two relatively thin elongated members 19, 20 between which vehicle 10 is placed for launching. Member 19 of launcher 12 is placed on a launching surface 22, which may be a floor or pavement, etc., and member 20 is forcefully moved against roller 16 to launch the vehicle. In another embodiment, the launcher may include only a single member similar to member 20, the vehicle is placed on surface 22 for launching, and the single member 20 is forcefully moved against roller 16 to launch the vehicle.

Launcher 12 may be connected to a track 24 so that vehicle 10 when launched by launcher 12 is propelled onto track 24. Alternatively, vehicle 10 may simply be launched onto or along surface 22.

Vehicle 10 may also be launched without a launcher using surface 22 and one's finger(s), fist, etc. When launched without a launcher (FIG. 5), vehicle 10 is simply placed on surface 22 and one's finger(s), fist, etc. is forcefully moved against roller 16. If desired, the vehicle 10 may be placed on a track and launched with one's finger or a single launch member.

In all embodiments, the entertainment value is high because the vehicle may be launched at high speed, which speed depends to a certain extent upon the user's skill or technique. Because of this skill or technique factor, users may compete with the vehicles in distance or speed races, which significantly increases the entertainment value.

Figure 3:
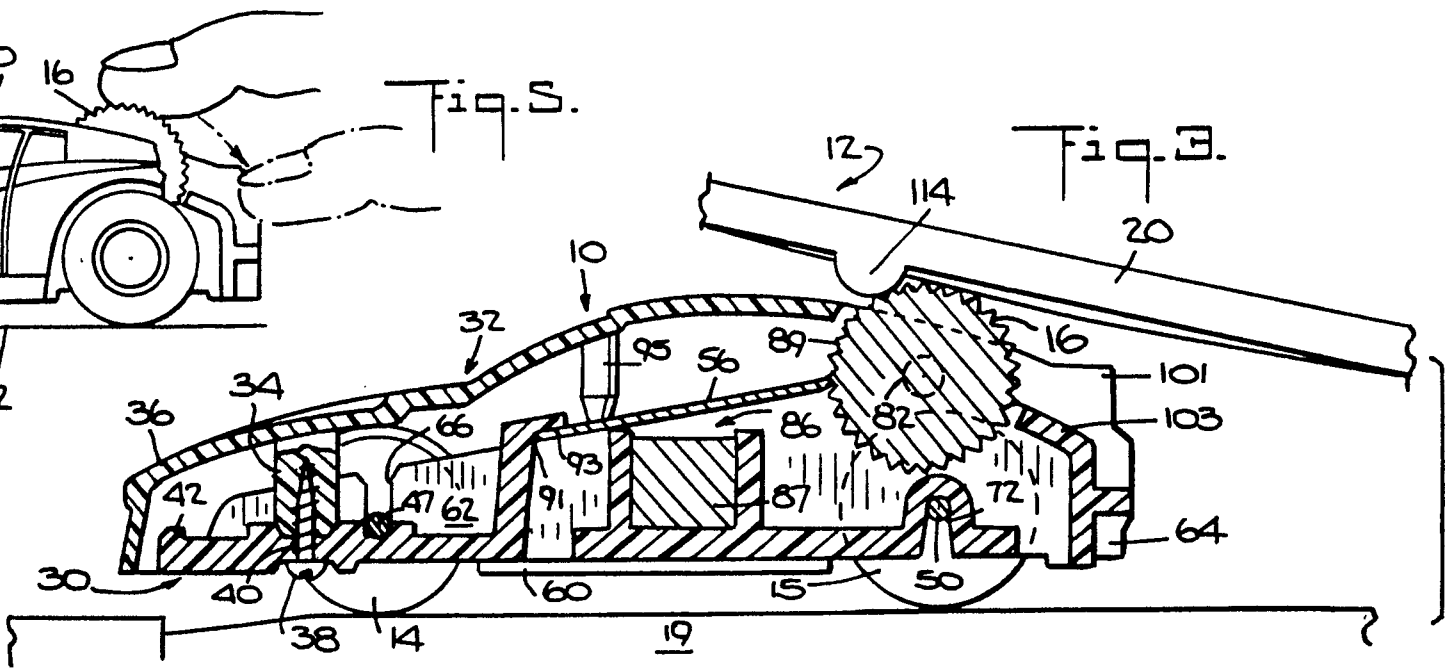
FIG. 3 is a longitudinal cross-sectional view of the toy vehicle according to the invention depicted in the launching position of FIG. 2.

Referring to FIGS. 3 and 5, toy vehicle 10 comprises a chassis 30 and a body 32 having cooperating structure for snap-fitting the body to the chassis. In addition, body 32 is secured to chassis 30 by means of an internally threaded projection 34 in the front portion 36 of body 32 which receives a screw 38 passed through a hole 40 in the front portion 42 of chassis 30. Both chassis 30 and body 32 are plastic, one-piece molded parts. Accordingly, manufacture and assembly are simplified.

Figure 4:
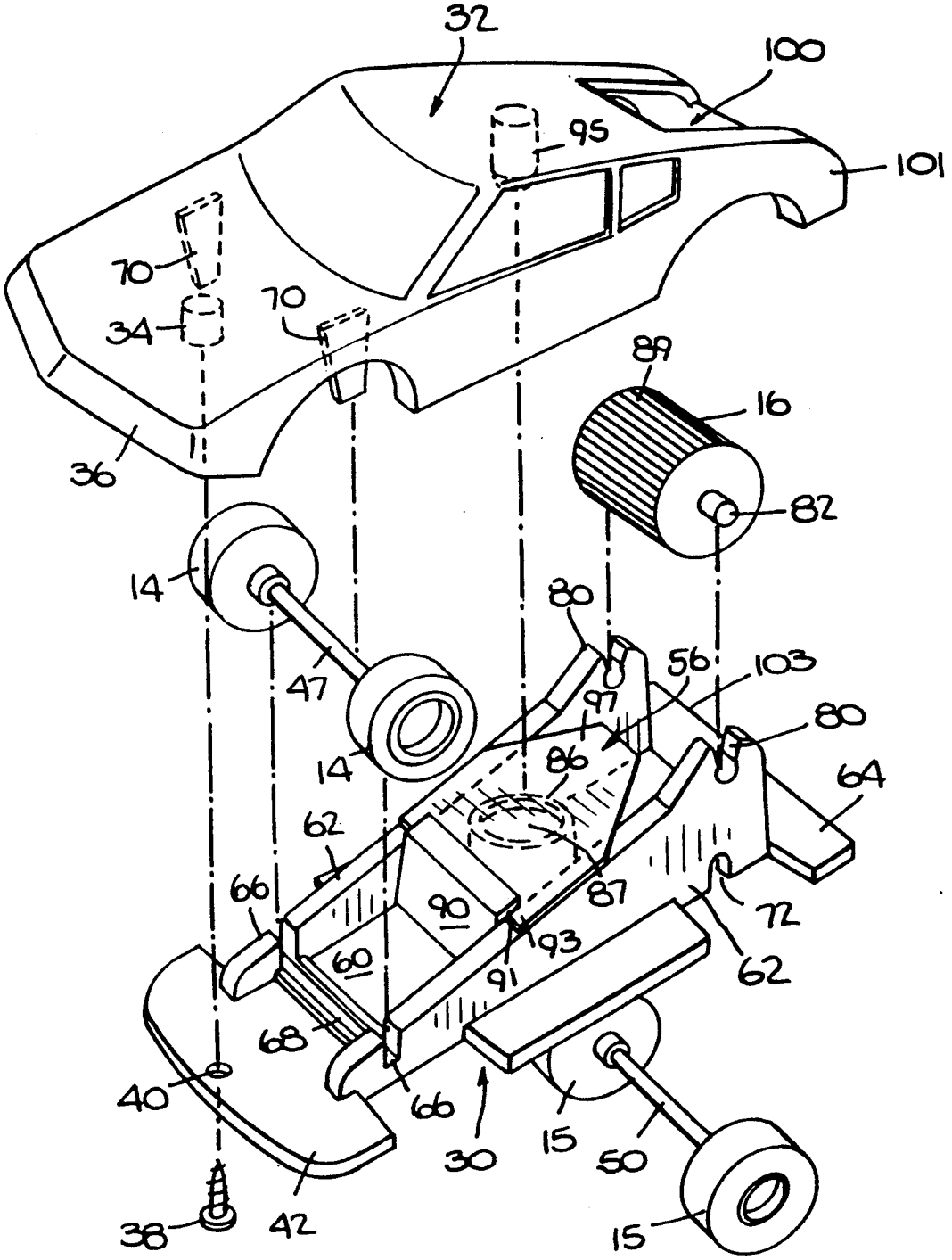
FIG. 4 is an exploded perspective view of the toy vehicle according to the invention.

Referring to FIG. 4, vehicle 10 also includes front wheels 14 rotatably connected to a front axle 47, rear wheels 15 rotatably connected to a rear axle 50, roller 16, weight 87 and a noise-making plate 56. These parts are all mounted to chassis 30 before body 32 is secured to the chassis. Chassis 30 includes a generally plate-like bottom 60 from which spaced flange-like sides 62 project upwardly and slope so as to increase in height from the front portion 42 of the chassis to the rear portion 64. Sides 62 in the front portion 42 of chassis 30 include upwardly-opening spaced slots 66 and bottom 60 includes an upwardly-facing, generally circular recess 68 extending between slots 66 to receive in snap-fit fashion front axle 47. Body 32 in the front portion 36 includes spaced downwardly-projecting tabs 70 which in the assembled condition of vehicle 10 (FIG. 3) contact front axle 47 and maintain it seated in slots 66 and recess 68 against upward forces generated when the vehicle is pressed downwardly against the surface it is supported on.

A similar slot/recess arrangement is provided for mounting rear axle 50, comprising downwardly-opening spaced slots 72 (FIG. 4) in sides 62 in the rear portion 64 of chassis 30 and a downwardly-facing recess (not shown) extending between the slots in the bottom 60 of chassis 30 for receiving in snap-fit fashion rear axle 50.

Roller 16 (FIG. 4) is mounted to chassis 30 by means of upwardly-opening spaced slots 80 in sides 62 in the rear portion 64 of chassis 30 which receive in snap-fit fashion axle 82 to which roller 16 is rotatably mounted. Roller 16 is thus mounted to chassis 30 in a free-wheeling manner and may be rotated simply by applying a tangential force thereto. Chassis 30 includes in the central portion thereof a cylindrical receptacle 86 for receiving a like-shaped weight 87 therein which stabilizes vehicle 10 and gives it sufficient weight to provide a suitable inertia to enable the vehicle to travel a suitable distance after launch.

Vehicle 10 is provided with a noise maker which emits a sound during launch. The noise maker comprises flexible metal or plastic plate 56 (FIGS. 4 and 5) and ridges 89 in roller 16. Chassis 30 includes a central rib 90 adjacent weight receptacle 86, which has a rearwardly opening slot 91 which receives therein one end 93 of plate 56. A downwardly projecting tab 95 is provided in body 32 to contact plate 56 in the assembled condition of the vehicle generally above receptacle 86. Tab 95 in cooperation with slot 91 holds the front portion 93 of plate 56 stationary against the top of receptacle 86 while permitting the rear portion 97 to flex about an axis in the plane of plate 56 running through the point of contact of tab 95 with plate 56. The rear portion 97 of plate 56 is tapered inwardly in width to form an edge which in the assembled condition of the vehicle contacts ridges 89 and flexes as roller 16 is rotated during launching of the vehicle. A high speed sound is produced by rotating the roller at high speed.

Roller 16 is mounted in chassis 30 above rear axle 50 (FIG. 2), which provides stability and tends to prevent the front of the vehicle from rising during launching from the generally downward force applied to the roller in the rear of the vehicle. To make roller 16 accessible, it is mounted relatively high in chassis 30, and body 32 has an opening 100 in the rear portion 101 thereof through which the outer peripheral portion of roller 16 projects. Opening 100 in body 32 also exposes a sloping rear surface 103 in chassis 30, which surface is sloped and positioned to provide a following surface to the launcher or one's finger, fist, etc., after it leaves roller 16. The sloping rear surface 103 and the position of roller 16 in the rear portion 101 of the vehicle prevents the front of the vehicle from rearing up and the front wheels 14 from rising, as would otherwise occur when the finger, fist, etc. rolls off the roller and contacts the rear of the car with great force. The position of the roller 16 above rear axle 50 and the relatively short distance between the rear wheels 15 and the rear portion 101 of the vehicle tend to prevent pivoting of the vehicle when a downward force is applied to the roller 16 in the rear of the vehicle and allow a greater force to be applied.

Vehicle 10 is simple in construction since all parts may be fitted to a one-piece molded chassis without fasteners, and a one-piece body portion may be snap-fitted to the assembled chassis, and then secured by a single fastener.

Rear wheels 15 of vehicle 10 are either made of natural or synthetic rubber or provided with a coating thereof to enhance frictional resistance between the vehicle and the surface upon which the vehicle is launched. Front wheels 14 may, but need not be, made of or coated by rubber.

Figure 2:
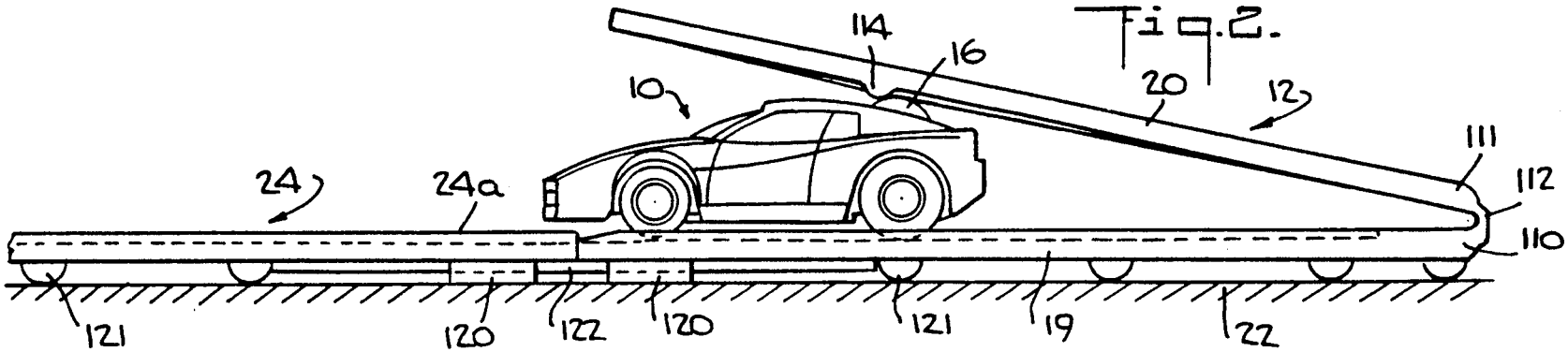
FIG. 2 is a side view of the toy vehicle, launcher and track depicted in FIG. 1 showing the vehicle in its launching position.

Referring now to FIG. 2, launcher 12 comprises a top elongated, rectangular plate-like member 20 and a bottom elongated, rectangular plate-like member 19 which are approximately the same width and length and are hinged together at respective ends thereof 110, 111. Preferably, members 110 and 111 are made of plastic and connected together by means of a so-called living hinge 112. As such, launcher 12 may be molded in one piece, and is inexpensive to manufacture. Launcher member 20 has a rib 114 (FIG. 3) which extends across the width of the lower surface thereof located so as to define the launch position of the vehicle.

As depicted in FIG. 2, rib 114 is located to position the front of vehicle 10 adjacent the free edges of the lower and upper members 19, 20 when rib 114 contacts a front portion of roller 16, as shown in FIGS. 2 and 3. Rib 114 restrains the vehicle from moving until sufficient force from the top launching member 20 overcomes the ability of rib 114 to hold the vehicle back. This causes the vehicle 10 to shoot out with greater speed. Vehicle 10 and launcher 12 are sized so that members 19 and 20 form a relatively small acute angle with vehicle 12 therebetween in its launching position (FIG. 2). This acute angle depends on the size and configuration of the roller 16 and the vehicle and is generally less than about 30° for small hand-held vehicles and preferably at an angle of 12° for such small hand-held vehicles. Launcher 12 is of sufficient length behind the vehicle 12 (FIG. 2) to accommodate a fist or foot so that a user may forcefully bang or stomp on the launcher. Also sufficient distance is provided forward of rib 114 that continued force may be applied to roller 16 as the vehicle is being launched. A great launching force is exerted because as the upper member 20 of launcher 12 is forced downwardly towards bottom member 19, a considerable length of the upper member 20 forward of rib 114 contacts roller 16 and imparts energy to vehicle 10 over a considerable distance. As the launcher members converge, the vehicle will be forced out and released from the launcher with a snap and propelled at great speed.

Bottom launcher member 19 may be provided with upwardly projecting flanges 116 (FIG. 1) at the side edges thereof to define a guide within which vehicle 10 is constrained during launching. In the preferred launching position, lower member 19 rests on surface 22 and upper member 20 is forcefully moved towards the lower member. Although vehicle 10 in its launching position has been shown as being fully supported by lower member 19, the vehicle wheels, or some of them, may be supported directly by surface 22. Launcher is preferably made from a flexible, tough material such as ABS or polypropylene and may be about ⅛ inch to about ¼ inch in thickness.

Referring to FIGS. 1 and 2, launcher may be connected to a track 24 by any suitable means, preferably by simply plugging the track into the bottom launcher member 19. As shown in FIG. 2, the adjacent ends of an end section 24*a* of track 24 and of the bottom member 19 each include a recess 120 shaped to receive opposite ends of a tongue member 122 to engage the end track section 24a to the launcher. Ribs 121 (FIG. 2) may be provided on the bottom of bottom member 19 to place the top of bottom member 19 and the top of track 24 at the same height to thereby provide a smooth transition from launcher 12 to track 24. As discussed above, vehicle 10 may be launched directly onto surface 22, or onto track 24, with or without a launcher.

Referring to FIGS. 6 and 7, roller 16 may be of various lengths and diameters, the longer and wider the roller, i.e., the exposed part of the roller, the greater the thrust of the vehicle as it is launched. As shown in FIG. 8, vehicle 10 may be provided with interchangeable accessories, for example, engines 129 may be detachably attached to the front portion 36 of vehicle body 32 by any suitable means, for example, a projection 130, receptacle 131 snap fit.

Although illustrative embodiments of the invention have been described and illustrated, it will be understood that the invention is not limited to the precise embodiments described and shown, and that various changes and modifications may be effected by one skilled in the art without departing from the scope or spirit of the invention.

What is claimed is:

1. A toy vehicle comprising a chassis, two wheels, means mounting said wheels to said chassis to rotate about a first axis, a roller, means for mounting said roller to said chassis to rotate about an axis generally above said first axis, a body having an opening through which said roller projects, and means for attaching said body to said chassis.

2. The toy vehicle of claim 1 comprising at least one additional wheel and means for rotatably mounting said at least one additional wheel to said chassis forwardly of said two wheels.

3. The toy vehicle of claim 2 wherein said means mounting said two wheels, said means mounting said at least one additional wheel and said means mounting said roller permit said wheels and said roller to be mounted to said chassis independently of said body to form a chassis subassembly.

4. The toy vehicle of claim 3 including a weight and means in said chassis for mounting said weight thereto.

5. A toy vehicle comprising a body, means for supporting said body relative to a surface so that said toy vehicle may be moved along the surface with relatively low friction resisting movement of said toy vehicle along the surface, a roller coupled to said toy vehicle so as to be substantially freely rotatable while said toy vehicle is supported on the surface stationary relative thereto by said supporting means, said roller being positioned at a rear portion of said body to be contacted and moved relative to said toy vehicle by an object functioning as a launcher such that when said toy vehicle is between a support and the object, forceful movement of the object against said roller at least in a direction towards the support forces said toy vehicle to be propelled from between the support and the object.

6. The toy vehicle of claim 5 wherein said means for supporting comprises wheels and means for attaching said wheels to said body so that said wheels support said body and rotate relative to said toy vehicle.

7. The toy vehicle of claim 5 wherein said means for supporting comprises a chassis, means attaching said body to said chassis and means attached to said chassis supporting said chassis on the surface with said relatively low friction resisting movement of said toy vehicle on the surface.

8. The toy vehicle of claim 7 wherein said means attached to said chassis supporting said chassis comprises wheels and means for attaching said chassis to said wheels so that said wheels support said chassis and rotate relative to said toy vehicle.

9. The combination of the toy vehicle of claim 5 and a launcher therefor which comprises a relatively flat, relatively stiff elongated member configured to contact said roller and propel said toy vehicle from between the support and said elongated member upon forceful movement of said elongated member in said direction.

10. The combination of the toy vehicle of claim 5 and a launcher therefor which comprises first and second relatively flat, relatively stiff elongated members and means hingedly connecting said members together at respective first ends thereof, a first of said members being configured to contact said roller while said toy vehicle rests on a second of said members and propel said toy vehicle from between said members upon forceful movement of said first member in said direction.

11. A toy vehicle comprising a body, means for supporting said body relative to a surface including two wheels and an axle to which said two wheels are coupled, a roller coupled to said vehicle so as to be substantially freely movable while said vehicle is supported on the support stationary relative thereto by at least said two wheels, said roller being positioned at a rear portion of said body to be contacted and moved relative to said vehicle by an object functioning as a launcher such that when said vehicle is supported on a support by at least said two wheels between the support and the object, forceful movement of the object against said roller at least in a direction towards the support forces said vehicle to be propelled from between the support and the object.

12. The toy vehicle of claim 11 wherein said means for supporting comprises a chassis, means for mounting said axle to said chassis and means for mounting said body to said chassis.

13. The combination of the toy vehicle of claim 11 and a launcher therefor which comprises a relatively flat, relatively stiff elongated member configured to contact said roller and propel said vehicle from between the support and said elongated member upon forceful movement of said elongated member in said direction.

14. The combination of the toy vehicle of claim 13 and a launcher therefor which comprises first and second relatively flat, relatively stiff elongated members and means hingedly connecting said members together at respective first ends thereof, a first of said members being configured to contact said roller while said vehicle rests on a second of said members and propel said vehicle from between said members upon forceful movement of said first member in said direction.

15. A toy vehicle comprising a body, means for supporting said body relative to a surface including at least two rear wheels and a rear axle to which said rear wheels are coupled and at least one front wheel and a front axle to which said at least one front wheel is coupled, a roller coupled to said vehicle so as to be substantially freely movable while said vehicle is supported on the support stationary relative thereto be at least said front and rear wheels, said roller being positioned projecting from a rear portion of said body to be contacted and rotated relative to said vehicle by an object functioning as a launcher such that when said vehicle is supported on a support by at least said wheels between the support and the object, forceful movement of the object against said roller at least in a direction towards the support forces said vehicle to be propelled from between the support and the object.

16. The toy vehicle of claim 15 wherein said means for supporting comprises a chassis, means for mounting said front and rear axles to said chassis and means for mounting said body to said chassis.

17. The combination of the toy vehicle of claim 15 and a launcher therefor which comprises a relatively flat, relatively stiff elongated member configured to contact said roller and propel said vehicle from between the support and said elongated member upon forceful movement of said elongated member in said direction.

18. The combination of the toy vehicle of claim 15 and a launcher therefor which comprises first and second relatively flat, relatively stiff elongated members and means hingedly connecting said members together at respective first ends thereof, a first of said members being configured to contact said roller while said vehicle rests on a second of said members and propel said vehicle from between said members upon forceful movement of said first member in said direction.

* * * * *